US011558696B2

(12) United States Patent
Rosenkranz

(10) Patent No.: US 11,558,696 B2
(45) Date of Patent: Jan. 17, 2023

(54) METHOD FOR DIRECTIONAL SIGNAL PROCESSING FOR A HEARING AID AND HEARING SYSTEM

(71) Applicant: SIVANTOS PTE. LTD., Singapore (SG)

(72) Inventor: Tobias Daniel Rosenkranz, Bubenreuth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/388,479

(22) Filed: Jul. 29, 2021

(65) Prior Publication Data

US 2022/0038828 A1 Feb. 3, 2022

(30) Foreign Application Priority Data

Jul. 29, 2020 (DE) ..... 10 2020 209 555.8

(51) Int. Cl.
*H04R 25/00* (2006.01)

(52) U.S. Cl.
CPC ..... *H04R 25/407* (2013.01); *H04R 25/356* (2013.01); *H04R 25/405* (2013.01); *H04R 25/505* (2013.01)

(58) Field of Classification Search
CPC .. H04R 25/407; H04R 25/505; H04R 25/356; H04R 25/405; H04R 2225/43
USPC ..... 381/313
See application file for complete search history.

(56) References Cited

U.S. PATENT DOCUMENTS

| | | | | |
|---|---|---|---|---|
| 9,301,049 | B2 | 3/2016 | Elko et al. | |
| 10,412,507 | B2 | 9/2019 | Fischer | |
| 10,659,890 | B2 | 5/2020 | Dressler et al. | |
| 10,856,087 | B2 | 12/2020 | Pedersen et al. | |
| 2009/0175466 | A1 | 7/2009 | Elko et al. | |
| 2010/0310084 | A1 | 12/2010 | Hersbach | |
| 2019/0158963 | A1 * | 5/2019 | Best | H04R 25/505 |

(Continued)

FOREIGN PATENT DOCUMENTS

| | | | | |
|---|---|---|---|---|
| DE | 102017206788 | B3 * | 8/2018 | G10L 21/0208 |
| DE | 102019205709 | B3 | 7/2020 | |
| EP | 3461147 | A1 | 3/2019 | |

(Continued)

*Primary Examiner* — Phylesha Dabney
(74) *Attorney, Agent, or Firm* — Laurence A. Greenberg; Werner H. Stemer; Ralph E. Locher

(57) ABSTRACT

A method for directional signal processing for a hearing aid includes generating first and second input signals from an ambient sound signal using first and second input transducers of the hearing aid and forming first and second directional signals based on the input signals. The directional signals have relative attenuations in directions of first and second useful signal sources. First and second amplification parameters for amplification of first and second useful signals of the signal sources are ascertained. A reference directional characteristic is defined for a reference directional signal. Based on the amplification parameters as a function of the reference directional characteristic, corrected first and second amplification parameters are ascertained so that an output directional signal, formed as a sum of the directional signals weighted by using the corrected amplification parameters, merges into a linearly scaled reference directional signal, if the first and second amplification parameters are equal.

14 Claims, 3 Drawing Sheets

(56) References Cited

U.S. PATENT DOCUMENTS

2020/0336844 A1 10/2020 Petrausch et al.

FOREIGN PATENT DOCUMENTS

| | | | | | |
|---|---|---|---|---|---|
| EP | 3503581 | A1 * | 6/2019 | ..... | G10L 21/0232 |
| EP | 3588981 | A1 | 1/2020 | | |
| JP | 2018186500 | A | 11/2018 | | |
| WO | 2007106399 | A2 | 9/2007 | | |

* cited by examiner

METHOD FOR DIRECTIONAL SIGNAL PROCESSING FOR A HEARING AID AND HEARING SYSTEM

CROSS-REFERENCE TO RELATED APPLICATION

This application claims the priority, under 35 U.S.C. § 119, of German Patent Application DE 10 2020 209 555.8, filed Jul. 29, 2020; the prior application is herewith incorporated by reference in its entirety.

BACKGROUND OF THE INVENTION

Field of the Invention

The invention relates to a method for directional signal processing for a hearing aid, wherein a first input signal is generated from a sound signal of the surroundings by a first input transducer of the hearing aid, a second input signal is generated from the sound signal of the surroundings by a second input transducer of the hearing aid, a first directional signal and a second directional signal are each formed on the basis of the first input signal and the second input signal, the second directional signal has a relative attenuation in the direction of a first useful signal source, the first directional signal has a relative attenuation in the direction of a second useful signal source, and a first amplification parameter for an amplification of a first useful signal of the first useful signal source and a second amplification parameter for an amplification of a second useful signal of the second useful signal source are ascertained.

In a hearing aid, an ambient sound is converted by using at least one input transducer into an input signal which is processed specifically by frequency band and in particular in a manner adapted individually to the wearer for that purpose in dependence on a hearing deficit of the wearer to be corrected and also amplified at the same time. The processed signal is converted through an output transducer of the hearing aid into an output sound signal, which is conducted to the ear of the wearer. Often automatic amplification control ("automatic gain control", AGC) and often also dynamic compression is applied to the input signal or to an already preprocessed intermediate signal in the scope of the signal processing, in which the input signal is usually only linearly amplified up to a defined limiting value, and a lesser amplification is applied above the limiting value to thus compensate for level peaks of the input signal. That is in particular supposed to prevent sudden, loud sound events from resulting in a loud output sound signal for the wearer due to the additional amplification in the hearing aid.

However, such an AGC having integrated dynamic compression in that case first reacts to sound events independently of the direction thereof. If the wearer of a hearing aid is in a complex hearing situation, for example in a conversation with multiple conversation partners, a conversation partner can trigger the compression, for example, due to a brief outcry or loud laugh, whereby the conversation contributions of another conversation participant are noticeably suppressed, because of which the comprehension can suffer for the wearer.

BRIEF SUMMARY OF THE INVENTION

It is accordingly an object of the invention to provide a method for directional signal processing for a hearing aid and a hearing system, which overcome the hereinaforementioned disadvantages of the heretofore-known methods and systems of this general type and which, in particular in conjunction with AGC and/or dynamic compression, is also suitable for complex hearing situations having more than one useful signal source.

With the foregoing and other objects in view there is provided, in accordance with the invention, a method for directional signal processing for a hearing aid, wherein a first input signal is generated from a sound signal of the surroundings by a first input transducer of the hearing aid, a second input signal is generated from the sound signal of the surroundings by a second input transducer of the hearing aid, a first directional signal and a second directional signal are each formed on the basis of the first input signal and the second input signal, the second directional signal has a relative attenuation in the direction of a first useful signal source, the first directional signal has a relative attenuation in the direction of a second useful signal source, and a first amplification parameter for an amplification of a first useful signal of the first useful signal source and a second amplification parameter for an amplification of a second useful signal of the second useful signal source are ascertained.

According to the invention, it is provided for this purpose that a reference directional characteristic for a reference directional signal, which can be represented in particular as a superposition of the first directional signal and the second directional signal, is defined, wherein a corrected first amplification parameter and a corrected second amplification parameter are ascertained on the basis of the first amplification parameter and/or the second amplification parameter as a function of the reference directional characteristic in such a way that an output directional signal, which is formed as the sum of the first directional signal weighted using the corrected first amplification parameter and the second directional signal weighted using the corrected second amplification parameter merges into a linearly scaled reference directional signal if the first amplification parameter is equal to the second amplification parameter, and at least one of the two corrected amplification parameters is different from the corresponding, underlying amplification parameter. Advantageous embodiments, which are partially inventive as such, are the subject matter of the dependent claims and the following description.

The output directional signal having the required property can be formed either as the corresponding described superposition, or on the basis of at least one suitable intermediate signal, wherein the formation of the output directional signal takes place in such a way that the required property is fulfilled in the event of equality of the two amplification parameters.

The first directional signal can in turn be formed for further signal processing in this case, so that in particular the signal components of the first directional signal are correspondingly incorporated into the output directional signal. For the case in which the output directional signal is formed from the signal components of at least one suitable intermediate signal—thus, for example, a formation of the first and second directional signal and of the output directional signal in each case on the basis of forward-directed and rear-directed cardioid signals—the first directional signal is in particular formed for the purpose of determining the corrected first and/or corrected second amplification parameter, since the directional information, in particular about the second useful signal source, from which the first directional signal can be extracted, is of decisive advantage for this purpose.

Preferably, an output signal is generated on the basis of the output directional signal, which is converted by an output transducer of the hearing aid into an output sound signal. For this purpose, in particular a frequency-band-dependent suppression of interference noises and/or feedback and/or further signal processing steps can also take place in the generation of the output signal from the output directional signal. The method can in particular be carried out by frequency band, so that the first and the second amplification parameter, the first and the second directional signal and the reference directional signal, and finally the corrected first and second amplification parameter and the output directional signal are ascertained or defined separately for each frequency band or for groups of individual frequency bands.

An input transducer in this case includes in particular an electroacoustic transducer, which is configured to generate a corresponding electrical signal from a sound signal. In particular, preprocessing can also be carried out by the respective input transducer during the generation of the first or second input signal, for example in the form of a linear pre-amplification and/or an A/D conversion. The correspondingly generated input signal is given in particular by an electrical signal, the current and/or voltage variations of which substantially represent the sound pressure variations of the air.

In this case, the direction of the first useful signal source is preferably oriented into the front half space with respect to a frontal direction of a user of the hearing aid defined by the intended use of the hearing aid. The first useful signal source is particularly preferably at least approximately in the frontal direction, so that in particular corresponding approximations of a frontal source can be performed for the signal processing. The direction of the second useful signal source is preferably oriented outside an angle range of +/−45°, particularly preferably +/−60° around the frontal direction. In particular, the direction of the second useful signal source is oriented into the rear half space.

A relative attenuation of the first directional signal is in particular to be understood in this case to mean that the relevant directional characteristic has a sensitivity in the direction of the second useful signal which is reduced in relation to the sensitivity averaged over all directions, and in particular has a local minimum, preferably a global minimum. Preferably, the first and the second directional signal have the most complete possible attenuation in the direction of the second or the first useful signal source, respectively.

The present invention solves the following problem in particular for this purpose: If an output directional signal is formed on the basis of two directional signals, which each have a relative, preferably complete attenuation in the direction of another useful signal source, thus, for example, the amplification of the second useful signal is dependent due to the output directional signal thus resulting not only on the corresponding amplification parameter, using which the second directional signal is weighted, but also on the direction of the second useful signal source, since the second directional signal has a nontrivial directional dependence in this regard. If the first directional signal then has a complete or approximately complete attenuation in the direction of the second useful signal source, the directional dependence cannot be compensated for by a correction term of the first directional signal. This can apply comparably to an amplification of the first useful signal by the first directional signal.

A corresponding correction therefore has to take place through the contributions of the respective directional signal itself. In the scope of the invention, this is triggered through a correction of the "scaling" of the respective directional signal, thus an adaptation of the respective amplification parameter, so that the corrected amplification parameter, on one hand, permits a consideration of this directional dependence of the corresponding directional signal.

On the other hand, the reference directional characteristic is specified as the "normal state," which is to be achieved if both useful signals are to be amplified using identical amplification parameters (the assumption in this case is that, inter alia, this applies in particular for identical useful signals, which are only incident from different directions). In this case, the amplification of the individual, "equally loud" useful signals is to result in the reference state, thus, for example, in an omnidirectional directional characteristic or a directional characteristic modeling a filtering by a pinna.

It is thus possible that not only useful signals from frontal useful signal sources, but, for example, also from the rear half space are amplified independently of their specific direction, in that the influence of the directional effect of a directional signal recording the relevant useful signal is compensated for by a corresponding correction of the amplification. An equivalent formulation on the level of intermediate signals possibly forming the directional signals is also possible.

The reference directional signal is preferably represented for this purpose on the basis of the two directional signals, so that the corrected amplification parameters can be ascertained on the basis of the corresponding coefficients in this representation. It is possible in particular for this purpose that, for example, only the second corrected amplification parameter has a real nontrivial correction to the second amplification parameter, while the first corrected amplification parameter is identical to the first amplification parameter. However, both corrected amplification parameters, thus the first and the second, can also each differ from their underlying first or second amplification parameter, respectively. This can be the case in particular if neither of the two useful signal sources is situated in a preferred direction (for example the frontal direction) with respect to the hearing aid.

The corrected second amplification parameter is advantageously ascertained in such a way that the second useful signal is amplified by the second amplification parameter in relation to the reference directional characteristic by way of the output directional signal, and/or the corrected first amplification parameter is ascertained in such a way that the first useful signal is amplified by the first amplification parameter in relation to the reference directional characteristic by way of the output directional signal. In this way, each of the two useful signals is amplified by the output directional signal, independently of the direction of the respective useful signal source using the respective "correct" amplification parameter for the individual useful signal.

This only then becomes possible at all in that those signal contributions in the output directional signal which originate, for example, from the second useful signal—thus, for example, a corresponding second directional signal—can be weighted on the basis of the corrected second amplification parameter so that a direction dependence of the second directional signal (or a comparable signal formed on the basis of at least one suitable intermediate signal having a relative attenuation in the direction of the first useful signal source) can be compensated for through the correction in the corrected second amplification parameter. This applies comparably to the signal contributions of the first useful signal in the output directional signal. In particular, the first corrected amplification parameter can be identical to the first amplification parameter.

The corrected second amplification parameter is expediently formed as a product of the second amplification factor and a correction factor, wherein the correction factor corresponds to a linear coefficient of the second directional signal in a representation of the reference directional signal as a linear combination of the first directional signal and the second directional signal.

A mathematical formulation may be achieved as follows: If one combines the input signals E1 and E2 to form a vector $E=[E1, E2]^T$, a first directional signal Xr1 formed on the basis of the two input signals may thus be at least approximately represented on the basis of the weights $w=[w1, w2]^T$ of the two input signals, thus $Xr1=E^T \cdot w$ (if the acoustic runtime between the two input transducers is less than one sample, which is usually given). In a comparable manner, the second directional signal Xr2 may be represented as $Xr2=E^T \cdot u$ having the weights $u=[u1, u2]^T$.

The output directional signal Xout may then be represented as $$Xout=E^T \cdot (G1' \cdot w+G2' \cdot u) \quad \text{(i)}$$

using the (scalar!) corrected first and second amplification parameters G1', G2'. If the reference directional signal Xref is also represented in the base E1, E2, a corresponding weighting vector $wref=[wr1, wr2]^T$: $Xref=E^T \cdot wref$ is thus also obtained in this case. On the basis of the first and the second directional signal Xr1, Xr2, as a result of their linear independence (since the relative attenuation is oriented in each case on a different useful signal source), the reference directional signal may then be represented as $$Xref=a \cdot Xr1+b \cdot Xr2, \text{ and thus} \quad \text{(ii)}$$

$$wref=a \cdot w+b \cdot u \text{(for both vector components)} \quad \text{(ii')}$$

A left multiplication of equation (ii') with $h^T(\alpha)$ is now carried out, wherein $h(\alpha)=[h1(\alpha), h2(\alpha)]^T$ represents a (measured, estimated, or modeled) transfer function on the hearing aid, which takes into consideration, for example, a propagation of a sound from a sound source to the first input transducer or to the second input transducer, and for $\alpha=0°$ merges into a relative transfer function from the first input transducer to the second input transducer with respect to a frontal sound source, and $\alpha$ is the angle for which preferably $h^T(\alpha) \cdot u=0$ applies (thus the angle of the direction for which the second directional signal preferably has an at least approximately total attenuation, namely the direction of the first useful signal source). From this, as a function of the knowledge of $h^T(\alpha) \cdot wref$ and $h^T(\alpha) \cdot w$, a value of a may be determined (the two scalar products can in particular be tabulated for various values of w1, w2, and $\alpha$). A value for b may also be determined on the basis of the value of a in one of the two components of (ii').

It may then be shown that the corrected amplification parameters $$G1'=a \cdot G1,$$

$$G2'=b \cdot G2 \quad \text{(iii)}$$

fulfill the desired property of merging in the output directional signal Xout according to equation (i) for G1=G2 into the reference directional signal Xref scaled with G1.

It has proven to be advantageous if the corrected first amplification parameter is ascertained as the first amplification parameter when the second directional signal has its minimal sensitivity in the direction of the first useful signal source and preferably has the most complete possible attenuation in this direction, and particularly preferably the first directional signal has its maximum sensitivity. If the direction of maximum sensitivity lies in the direction of the first useful signal for the first directional signal Xr1, in which the second direction signal does have its minimal sensitivity, this can in particular be used for normalizing of the first directional signal in such a way that the sensitivity in this direction is set to 1, and therefore $h^T(\alpha) \cdot w=1$ applies. If in addition the attenuation due to the second directional signal is at least approximately complete in this direction, thus $h^T(\alpha) \cdot u \approx 0$, a=1 may thus be set in equation (ii), whereby in equation (iii), G1'=G1, thus identity of first and corrected first amplification parameters results.

Preferably, a first intermediate signal and a second intermediate signal are formed on the basis of the first input signal and the second input signal, wherein the first directional signal is formed as a superposition of the first intermediate signal and the second intermediate signal, and at the same time an associated first superposition parameter is ascertained and/or the second directional signal is formed as a superposition of the second intermediate signal with the first intermediate signal, and at the same time an associated second superposition parameter is ascertained. In particular a forward-directed and a rear-directed cardioid signal Xc, Xa are used as the first intermediate signal and second intermediate signal. The first superposition parameter a1 and the second superposition parameter a2 then result from the representation $$Xr1=Xc+a1 \cdot Xa,$$

$$Xr2=a2 \cdot Xc+Xa, \quad \text{(iv)}$$

and can in particular be adaptively ascertained. In an important special case, a2=0, i.e., the second directional signal Xr2 is given by the rear-directed cardioid signal Xa, and therefore by the second intermediate signal Z2. This is the case, for example, if the first useful signal source, for which the second directional signal has a relative, preferably maximal, and particularly preferably total attenuation, lies in the region of the notch of the rear-directed cardioid signal or is assumed there.

In one advantageous embodiment, the corrected first amplification parameter G1' is formed as a product of the first amplification factor G1 and a first correction factor a, and the corrected second amplification parameter G2' is formed as a product of the second amplification factor G2 and a second correction factor b.

Preferably, a first reference superposition parameter aref1 and a second reference superposition parameter aref2 are defined for a superposition of the first intermediate signal Z1 and the second intermediate signal Z2 which forms the reference directional signal Xref, wherein the first correction factor a is formed on the basis of a product of the second superposition parameter a2 with the second reference superposition parameter aref2 and in particular on the basis of a deviation of the product from the first reference superposition parameter aref1, and/or wherein the second correction factor b is formed on the basis of a deviation of a product of the first superposition parameter a1 with the first reference superposition parameter aref1 from the second reference superposition parameter aref2. In this case, the output directional signal Xout is preferably formed on the basis of the first directional signal Xr1 weighted using the corrected first amplification factor G1' and on the basis of the second directional signal Xr2 weighted using the corrected second amplification factor G2' according to equation (iii) as $$Xout = G1' \cdot Xr1 + G2' \cdot Xr2 \quad (v)$$

$$= a \cdot G1 \cdot Xr1 + b \cdot G2 \cdot Xr2. \quad (v')$$

On the basis of equations (iv) and (ii), Xref may be specified as a function of the forward-directed and rear-directed cardioid signals Xc and Xa, respectively (thus as a function of the two intermediate signals Z1 and Z2 and in the present case with Z1=Xc and Z2=Xa):

$$Xref=(a+b\cdot a2)\cdot Xc+(a\cdot a1+b)\cdot Xa,$$

$$Xref=aref1\cdot Xc+aref2\cdot Xa \quad (ii'')$$

The linear factors in equation (ii"), which are associated with the forward-directed or rear-directed cardioid signal Xc or Xa, respectively, can be interpreted in this case as a first or second reference superposition parameter aref1 or aref2, respectively, thus $$aref1=a+b\cdot a2,$$

$$aref2=a\cdot a1+b. \quad (vi)$$

The correction factors a, b in equation (V) then result as a function of the two reference superposition parameters aref1, aref2 as $$a=(aref1-a2\cdot aref2)/(1-a1\cdot a2),$$

$$b=(aref2-a1\cdot aref1)/(1-a1\cdot a2). \quad (vii)$$

For the special case aref1=1, equation (vii) merges into $$a=(1-aref2\cdot a2)/(1-a1\cdot a2),$$

$$b=(aref2-a1)/(1\cdot a1\cdot a2). \quad (vii')$$

In a further advantageous embodiment, an effective first superposition parameter aeff1 and an effective second superposition parameter aeff2 are ascertained on the basis of the first and the second superposition parameter a1, a2, on the basis of the first and the second reference superposition parameter aref1, aref2, and on the basis of the first amplification parameter G1 and on the basis of the second amplification parameter G2, wherein the output directional signal Xout is formed on the basis of a superposition of the first intermediate signal Z1 weighted using the first effective superposition parameter aeff1 and of the second intermediate signal Z2 weighted using the second effective superposition parameter aeff2, thus in particular as Xout∝aeff1·Z1+aeff2·Z2.

Using the definitions of equations (iv) and (iii) the following representation may moreover be derived from equation (v):

$$Xout=G1\cdot[(a+b\cdot a2\cdot G2/G1)\cdot Xc+(a\cdot a1+b\cdot G2/G1)\cdot Xa]. \quad (viii)$$

A comparable representation may be obtained by excluding the second amplification parameter G2, wherein the representation (exclusion of G1) selected in equation (viii) is advantageous in particular for the case G1≥G2. The linear factors in equation (viii), which are assigned to the forward-directed or rear-directed cardioid signal Xc or Xa, respectively, can be interpreted in this case as a first or second effective superposition parameter aeff1 or aeff2, thus $$aeff1=a+b\cdot a2\cdot G2/G1,$$

$$aeff2=a\cdot a1+b\cdot G2/G1 \quad (ix)$$

with a, b given by the representation according to equation (vii) (or for the special case aref1=1 by equation vii'), so that equation (viii) merges into $$Xout=G1\cdot(aeff1\cdot Xc+aeff2\cdot Xa). \quad (viii')$$

For G1=G2, the first and the second effective superposition parameters aeff1, aeff2 merge into the first or second reference superposition parameter aref1, aref2, respectively, according to equation (vi). This may now be used to first represent the two correction parameters a, b, which according to equation (iii) are assigned to the two amplification parameters G1, G2, and finally to represent the two effective superposition parameters aeff1, aeff2 as a function of the reference superposition parameters aref1, aref2.

The specific form of Xout to be selected, thus according to equation (v) or equation (viii'), then preferably takes place as a function of which of the two representations (ii), (ii") is actually used for Xref. In particular, the value aref1=1 can be specified for equation (ii").

In the case that the second directional signal Xr2 is given by the second intermediate signal Z2, thus in particular by the rear-facing cardioid signal Xa (and thus a2=0 applies in equation iii), the first effective superposition parameter aeff1 is formed from the first reference superposition parameter aref1, thus aeff1=aref1.

Moreover, the following representation may be derived from equation (v) for Z1=Xc, Z2=Xa after some transformation:

$$Xout=Geff\cdot(Z1+(aeff2/aeff1)\cdot Z2) \quad (x)$$

with an effective amplification parameter Geff=(G1'+G2'·a2) and the ratio of the effective superposition parameters aeff2/aeff1=(G1'·a1+G2')/Geff. On the basis of the requirements that for G1=G2, the output signal Xout is to merge into a scaled reference signal Xref, and thus the effective superposition parameters aeff1, aeff2 are to merge into the associated reference superposition parameters aref1, aref2, and from the additional requirement that in this case the output signal Xout is to be amplified using the first amplification parameter G1, thus Geff=G1, the following equations result $$G1=Geff=G1\cdot a+G2\cdot b\cdot a2,$$

$$aref1=aref1=a+b\cdot a2,$$

$$aref2=aeff2=a\cdot a1+b. \quad (xi)$$

For the above-mentioned special case, that the second directional signal Xr2 is given by the second intermediate signal Z2 (in particular in the form of a rear-directed cardioid signal Xa), and thus a2=0 applies, and the first reference superposition parameter aref1=1 is set, the first correction factor a=1 (cf. equation vii'). Therefore, the corrected first amplification factor G1' is identical to the first amplification parameter G1'. For the second correction factor b, b=aref2−1 applies.

The following results therefrom for the output signal $$Xout=G1\cdot(Z1+a1\cdot Z2)+G2\cdot(aref2-a1)\cdot Z2. \quad (xii)$$

For G1=G2, it is clear that (xii) merges into the reference directional signal Xref=Z1+aref2·Z2 having the second reference superposition parameter aref2, which is scaled using G1.

Advantageously, for the case in which the second directional signal Xr2 is given by the second intermediate signal Z2, the second effective superposition parameter is formed in this case from the first superposition parameter a1 and a ratio of the corrected second amplification parameter G2' and the first amplification parameter G2'/G1.

On the basis of the first directional signal Xr1=Z1+a1·Z2, in the mentioned special case (aref1=1, a2=0, and thus aeff1=1 in equation ix), on the basis of equation (x), in particular a formulation equivalent to equation (xii) can be obtained if the second useful signal is substantially exclusively to be elevated by the second intermediate signal:

$$Xout = G1 \cdot (Z1 + (aeff2/aeff1) \cdot Z2) \quad \text{(xiii)}$$
$$= G1 \cdot \{Z1 + [a1 + (aref2 - a1) \cdot G2/G1 \cdot Z2\},$$

wherein the term (aref2−a1)·G2 in aeff2 forms the corrected second amplification parameter G2'. It is to be noted that for the mentioned case, the second directional signal Xr2 is given by the second intermediate signal Z2, and thus the second superposition parameter a2=0 was set. In this way, in equation (x), the effective amplification parameter Geff becomes G1 (a=1), which was taken into consideration in equation (xiii).

It has further proven to be advantageous if the reference directional characteristic of the reference directional signal is selected as an omnidirectional directional characteristic or is selected in such a way that a shading effect of human ears is simulated.

If a forward-directed and a rear-directed cardioid signal Xc, Xa are each used as intermediate signals of the signal processing, for example to form at least the first directional signal, in the case of the omnidirectional reference directional characteristic, for the two reference superposition parameters aref1, aref2 in the reference directional signal Xref=aref1·Xc+aref2·Xa, the values aref1=1, aref2=−1 apply. In many situations, the most omnidirectional possible hearing sensation is desired as the starting position.

For the case in which a shading effect of human ears is to be simulated by the reference directional characteristic, the reference superposition parameters aref1, aref2 are preferably ascertained beforehand in such a way that the reference directional signal Xref=aref1·Xc+aref2·Xa simulates the desired spatial sensitivity, as results due to the shading of the pinna on a human ear. In this case, the ascertainment of aref1, aref2 can take place on a generic ear model (for example of a KEMAR), or also can be adapted to the wearer of the hearing aid individually by corresponding measurements.

Preferably, the first directional signal has a maximum attenuation in the direction of the first useful signal source and/or the second directional signal has a maximum, in particular total attenuation in the direction of the second useful signal source. In this way, the influences of the respective useful signals on the respective other directional signal and thus on the relative amplification parameter may be minimized particularly effectively.

Advantageously, the first directional signal is generated by using adaptive directional microphonics in particular on the basis of a first intermediate signal and a second intermediate signal, and/or the second directional signal is generated by using adaptive directional microphonics in particular on the basis of the first and the second intermediate signal. In this way, the relevant directional signal can have the lowest possible, preferably minimal, sensitivity in the direction of one of the two useful signal sources, on one hand, so that in this direction a high, preferably maximum attenuation takes place, and the highest possible, preferably maximum, sensitivity in the direction of the respective other useful signal source.

It has furthermore proven to be advantageous in this case if the first intermediate signal is generated on the basis of a time-delayed superposition of the first input signal with the second input signal implemented by using a first delay parameter, and/or the second intermediate signal is generated on the basis of a time-delayed superposition of the second input signal with the first input signal implemented by using a second delay parameter. In particular, the first and the second delay parameter can be selected identically to one another, and in particular the first intermediate signal can be generated symmetrically to the second intermediate signal with respect to a preferred plane of the hearing aid, wherein the preferred plane is preferably assigned to the frontal plane of the wearer when wearing the hearing aid. An alignment of the directional signals on the frontal direction of the wearer facilitates the signal processing, since the natural viewing direction of the wearer is taken into consideration in this way.

Preferably, the first intermediate signal is generated in this case as a forward-directed cardioid directional signal and/or the second intermediate signal is generated as a rear-directed cardioid directional signal. A cardioid directional signal may be formed in that the two input signals are superimposed on one another using the acoustic runtime delay corresponding to the distance of the input transducers. In this way—depending on the sign of this runtime delay in the superposition—the direction of the maximum attenuation is in the frontal direction (rear-directed cardioid directional signal) or in the opposite direction thereto (forward-directed cardioid directional signal). The direction of maximum sensitivity is opposite to the direction of the maximum attenuation. This facilitates the further signal processing, since such an intermediate signal is particularly suitable for adaptive directional microphonics.

With the objects of the invention in view, there is concomitantly provided a hearing system having a hearing aid including a first input transducer for generating a first input signal from a sound signal of the surroundings and a second input transducer for generating a second input signal from the sound signal of the surroundings, and a control unit which is configured to carry out the above-described method. In particular, the control unit can be integrated into the hearing aid. In this case, the hearing system is given directly by the hearing aid. The advantages mentioned for the method and its refinements can be transferred correspondingly to the hearing system.

Other features which are considered as characteristic for the invention are set forth in the appended claims.

Although the invention is illustrated and described herein as embodied in a method for directional signal processing for a hearing aid and a hearing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
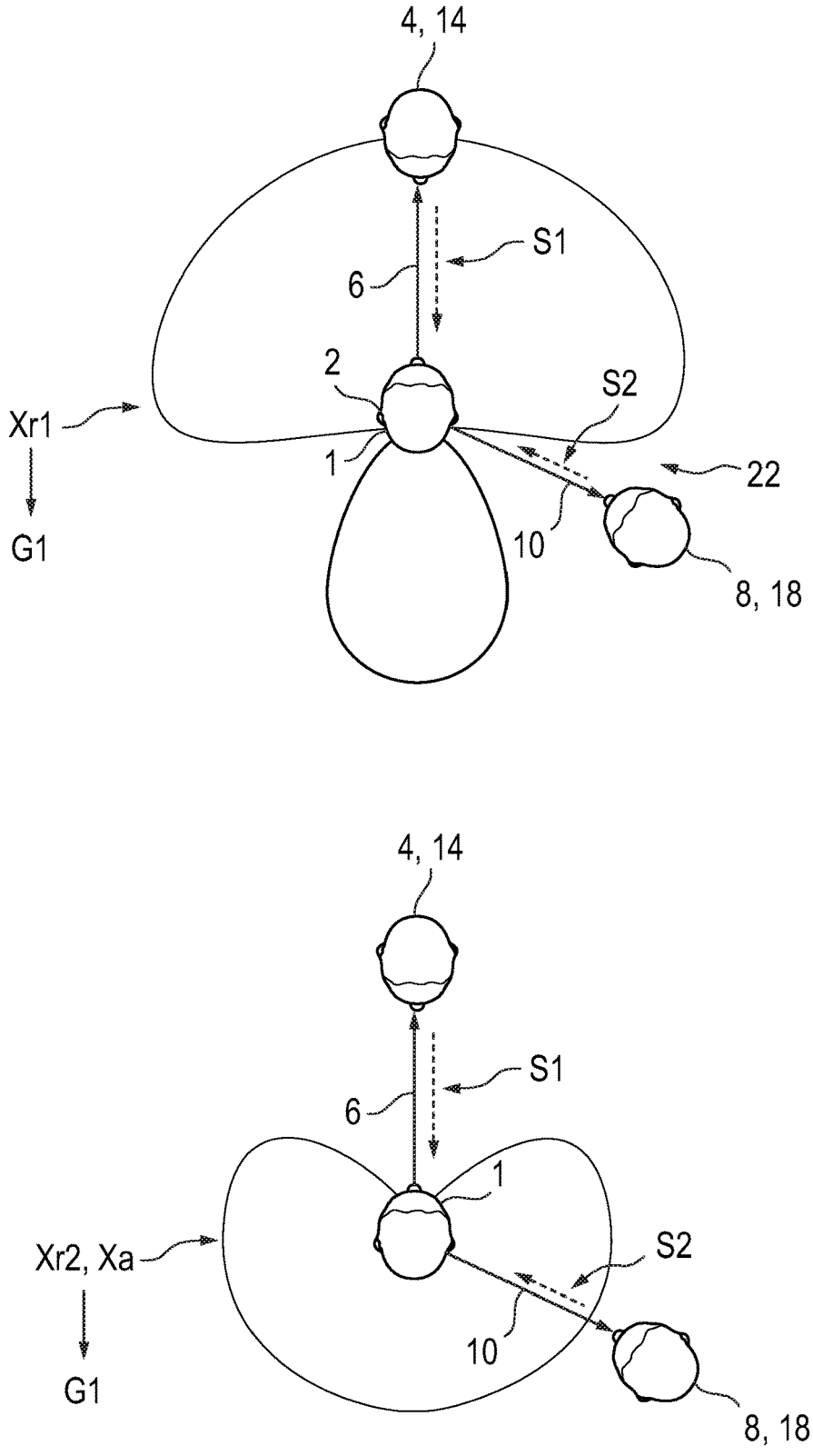
FIG. 1 is a top-plan view illustrating a conversation situation of a wearer of a hearing aid with two conversation partners.

Referring now in detail to the figures of the drawings, in which parts and dimensions corresponding to one another are each provided with the same reference signs, and first, particularly, to FIG. 1 thereof, there is seen a diagrammatic top view of a wearer 1 of a hearing aid 2, who is in a conversation situation with a first conversation partner 4 and a second conversation partner 8. The first conversation partner 4 is positioned in a first direction 6 with respect to the wearer 1, the second conversation partner 8 in a second direction 10 relative to the wearer 1. The first conversation partner 4 is the main conversation partner of the wearer 1 in this case, the second conversation partner 8 only participates in this conversation by way of isolated speech contributions. The described conversation situation is identical in this case for the top image and the bottom image of FIG. 1. The speech contributions of the first conversation partner 4 in this case form a first useful signal S1, and the speech contributions of the second conversation partner 8 form a second useful signal S2.

In order to then moderate the level peaks of the first useful signal S1 and the second useful signal S2 for the wearer 1 of the hearing aid 2 in an output sound signal of the hearing aid 2, as shown in the top image of FIG. 1, first a directional signal Xr1 is generated by using adaptive directional microphonics in such a way that this signal has a maximum and preferably complete attenuation in the second direction 10, in which the second conversation partner 8 is positioned. This means that the useful signal S2 is not acquired by the first directional signal Xr1. A compression factor which is thus calculated on the basis of the first directional signal Xr1 therefore reacts with respect to the two useful signal sources 14, 18, which are given by the first and second conversation partner 4 and 8, respectively, only to the first. A first amplification factor G1, which is ascertained in this case, determines the optimum signal amplification and thus implicitly also a corresponding compression ratio with respect to the first useful signal S1 of the first useful signal source 14 (thus of the first conversation partner 4) for each moment.

In the bottom image of FIG. 1, similarly to the top image, a second directional signal Xr2 in the same hearing situation is shown, which has a maximum and preferably complete attenuation in the first direction 6, thus the direction of the first conversation partner 4. Since the first direction 6 coincides with the frontal direction of the wearer 1, the second directional signal Xr2 is formed as a rear-directed cardioid directional signal Xa. The second amplification parameter G2, which is ascertained on the basis of the second directional signal Xr2 and assigned thereto, thus in each moment represents the optimum amplification with respect to the second useful signal S2 and in particular an associated compression ratio.

In an output sound signal of the hearing aid 2 for its wearer 1, to now be able to reduce the level peaks due to the conversation contributions of both the first conversation partner 4 and also the second conversation partner 8 to a level pleasant to the wearer 1 by using compression, on one hand, such an output signal could be formed from a linear combination of the first and the second directional signals Xr1, Xr2, which are each weighted using their corresponding amplification parameters G1, G2. Since the first directional signal Xr1 is also formed by using adaptive directional microphonics on the basis of a forward-directed cardioid directional signal and on the basis of the rear-directed cardioid directional signal Xa, such a linear combination would result in an output sound signal, the directional characteristic of which is similar in shape to that of the first directional signal Xr1, wherein a notch 22 of the maximum attenuation is shifted away from the second direction 10, however. This results on one hand in a possibly undesired, completely "deaf" region beyond the second useful signal source 18, which on the other hand can also fluctuate in its alignment as a result of the dependence of such a linear combination on the speech contributions of the first conversation partner 4.

Figure 2:
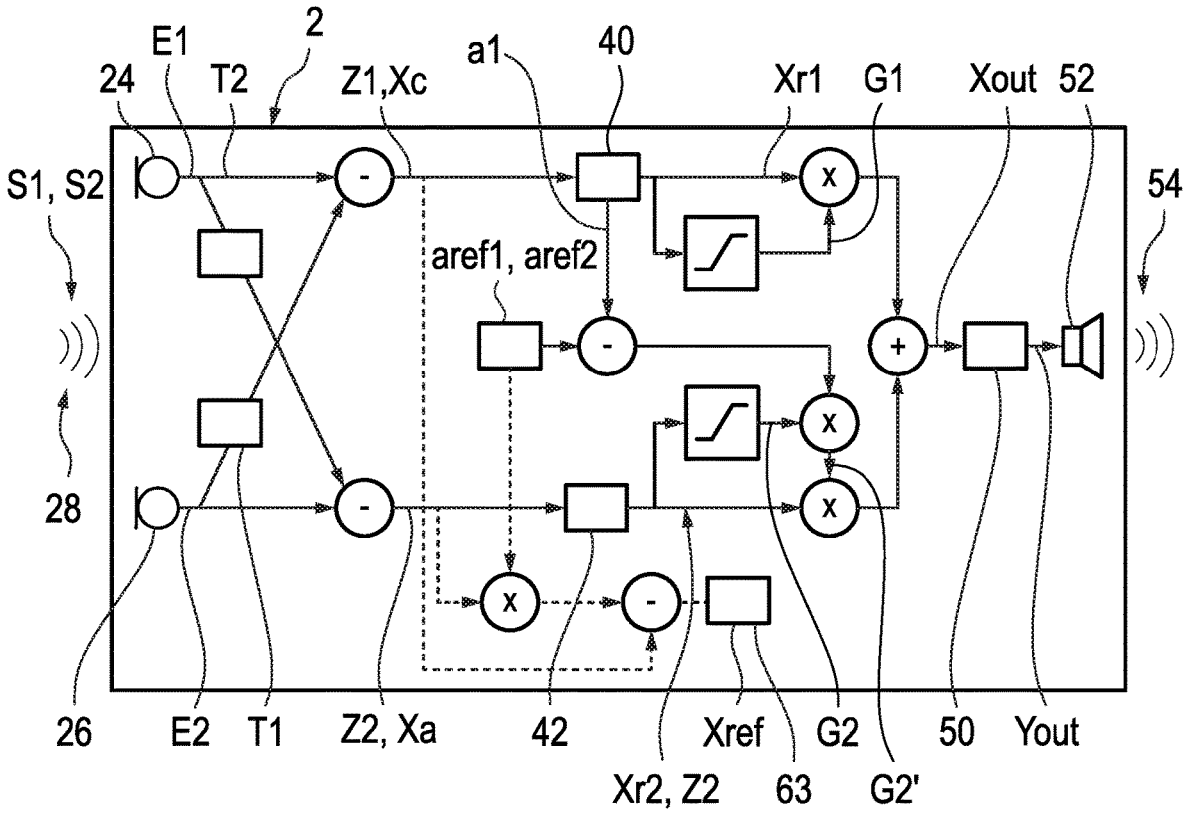
FIG. 2 is a schematic and block diagram illustrating preferred directional signal processing for the hearing aid in the conversation situation according to FIG. 1.

FIG. 2 schematically shows, in a block diagram, a method for directional signal processing for the hearing aid 2 according to FIG. 1 in the situation described therein, which in particular is to moderate the level peaks of the two useful signals S1, S2 of the useful signal sources 14, 18 given by the respective conversation partner 4, 8. A first input transducer 24 and a second input transducer 26, which are disposed in the hearing aid 2, respectively generate a first input signal E1 or a second input signal E2 from a sound signal 28. The sound signal 28 is the ambient sound in this case, which thus also includes the first and the second useful signals S1, S2. A possible preprocessing, for example, A/D, conversion, or the like, is already to be included in this case in the input transducers 24, 26, which moreover each have a preferably omnidirectional microphone.

The first input signal E1 is now superimposed with the second input signal E2, which was delayed by a first delay parameter T1, and a first intermediate signal Z1 is formed therefrom. Similarly thereto, the second input signal E2 is superimposed with the first input signal E1, which was delayed by a second delay parameter T2, and a second intermediate signal Z2 is formed in this way. In the present case and without restriction of the generality, the first and the second delay parameters T1, T2 are each identical (T1=T2) and in addition are selected in such a way that the first intermediate signal Z1 is given by a forward-directed cardioid directional signal Xc, and the second intermediate signal Z2 by the rear-directed cardioid directional signal Xa. The first directional signal Xr1=Z1+a1·Z2 according to FIG. 1 is now generated on the basis of the first intermediate signal Z1 and the second intermediate signal Z2 by using adaptive directional microphonics 40 with determination of a first superposition parameter a1 in such a way that the contributions of the second conversation partner 8, thus the second useful signal S2, are maximally suppressed in the first directional signal Xr1. The first amplification parameter G1 is ascertained for the first useful signal S1 on the basis of the first directional signal Xr1. The ascertained first amplification parameter G1 thus represents the optimum amplification and compression of the signal contributions of the first conversation partner 4 by the first directional signal Xr1.

Through the use of adaptive directional microphonics 42, the second directional signal Xr2, which maximally suppresses the contributions of the first conversation partner 4, thus the second useful signal S2, can be generated from the first intermediate signal Z1 and the second intermediate signal Z2. Since this conversation partner presently stands in the frontal direction in relation to the wearer 1, as already mentioned, the second directional signal Xr2 is given by the rear-directed cardioid directional signal Xa. The second directional signal Xr2 can be assumed in this case permanently as the rear-directed cardioid directional signal Xa, on one hand. On the other hand, a position change of the first conversation partner 4 can also be taken into consideration by using the adaptive directional microphonics 42 for the formation of the second directional signal Xr2 from the first and the second intermediate signal Z1, Z2.

Similarly to the first amplification parameter G1, the second amplification parameter G2 is furthermore determined on the basis of the second directional signal Xr2. This represents the optimum amplification and compression of the second useful signal S2 by the second directional signal Xr2.

In addition, a reference directional characteristic 63 is defined for a reference directional signal Xref. The reference directional signal Xref results in this case as a superposition from the two intermediate signals Z1, Z2 as $$Xref = aref1 \cdot Z1 + aref2 \cdot Z2$$

with an associated first reference superposition parameter aref1 and a second reference superposition parameter aref2, which are selected so that the reference directional signal Xref has the desired reference directional characteristics 63, thus, for example, simulates the spatial filter effect of the pinna on a human ear, in particular with respect to frequency band. An omnidirectional directional characteristic can also be selected for the reference directional signal Xref (which loses its directional effect in this way) for some or all frequency bands. The reference directional signal Xref is used in this case for the definition of the reference directional characteristic 63 and the reference superposition parameters aref1, aref2, and in the present case does not necessarily have to be generated as an independent signal from the two intermediate signals Z1 and Z2 (correspondingly shown by dashed lines); the reference superposition parameters aref1, aref2 can rather be defined beforehand. In particular, aref1=1 can be defined, so that the reference directional characteristic 63 of the reference directional signal Xref has no attenuation in the frontal direction.

For the following calculations, it is now taken into consideration that Xr2=Z2=Xa and therefore a2=0 applies, wherein moreover aref1=1 is set.

On the basis of the second amplification parameter G2, the first superposition parameter a1, and the reference superposition parameter aref2, a corrected second amplification parameter G2' is now ascertained as $$G2' = G2 \cdot (aref2 \cdot a1).$$

An output directional signal Xout is now formed on the basis of the first directional signal Xr1=Z1+a1·Z2, weighted using the first amplification parameter G1, and on the basis of the second directional signal Xr2, which presently corresponds to the second intermediate signal Z2, weighted using the corrected second amplification parameter G2', as $$\begin{aligned} Xout &= G1 \cdot Xr1 + G2' \cdot Z2 \\ &= G1 \cdot (Z1 + a1 \cdot Z2) + G2 \cdot (aref2 - a1) \cdot Z2. \end{aligned} \quad \text{(xii')}$$

If now, for example, the first useful signal S1 and the second useful signal S2 are equally loud in a frequency range, the same amplification parameter G1=G2 is thus assigned to each of them for this frequency range. In this case, in the output directional signal Xout, the contributions proportional to the first superposition parameter a1 mutually cancel out, and the output directional signal Xout merges into Xout=G1·(Z1+aref2·Z2), as in the reference directional signal Xref amplified ("scaled") using G1.

Instead of the described generation of the output directional signal Xout on the basis of the first directional signal Xr1 and the rear-directed cardioid signal Xa as the second intermediate signal Z2, the output directional signal Xout may also be generated in that, on the basis of the first superposition parameter a1, on the basis of the corrected second amplification parameter G2', and on the basis of the first amplification parameter G1, a first effective superposition parameter aeff1 and a second effective superposition parameter aeff2 are formed as $$\begin{aligned} aeff2 &= a1 + G2'/G1 \\ &= a1 + (aref2 - a1) \cdot G2/G1. \end{aligned} \quad \text{(xiii)}$$

The first effective superposition parameter aeff1 has the value aeff1=1 in the present special case, but can also assume nontrivial values in particular for a2≠0. The correspondingly formed output directional signal $$Xout = G1 \cdot (aeff1 \cdot Z1 + aeff2 \cdot Z2)$$

with aeff2 according to equation (xiv) and aeff1=1 then assumes the shape represented in equation (xii'). The output directional signal Xout has a directional characteristic in this case as a result of the present generation which has an amplification or attenuation by a factor G1 in the direction of the first useful signal source 14 (thus the direction of the first useful signal S1) in relation to the reference directional signal Xref, and has an amplification or attenuation by a factor G2 in the direction of the second useful signal source 18 (thus the direction of the second useful signal S2) in relation to the reference directional signal Xref (see also FIG. 3A and FIG. 3B in this regard).

Finally, on the basis of the output directional signal Xout, an output signal Yout is generated through signal processing steps 50, which in particular can include an additional frequency-band-dependent noise suppression, which output signal is converted by an output transducer 52 of the hearing aid 2 into an output sound signal 54.

Figure 3A:
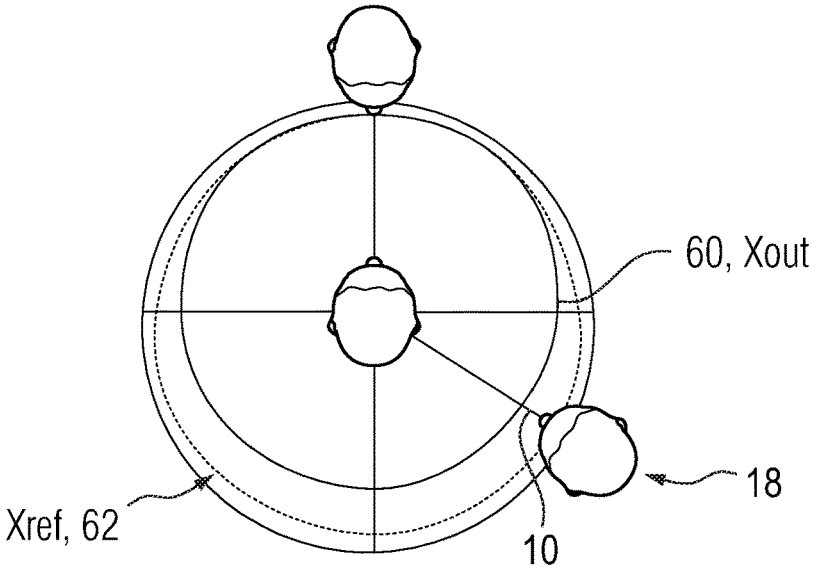
FIG. 3A is a top-plan view illustrating a directional characteristic of an output signal resulting from the directional signal processing according to FIG. 2.

In FIG. 3A, for the hearing situation of the wearer 1 shown in FIG. 1, a directional characteristic 60 of the output directional signal Xout generated as described in FIG. 2 is shown. The reference directional characteristic 62 (dashed line) is given in this case as an omnidirectional directional characteristic. For better clarity, the first amplification parameter G1 is selected as 0 dB in this case, while the second amplification parameter G2 is selected as −6 dB. The resulting directional characteristic 60 of the output directional signal Xout has a noticeable deviation from the omnidirectional reference directional characteristic 62 in the second direction 10 (thus the direction of the second useful signal source 18).

Figure 3B:
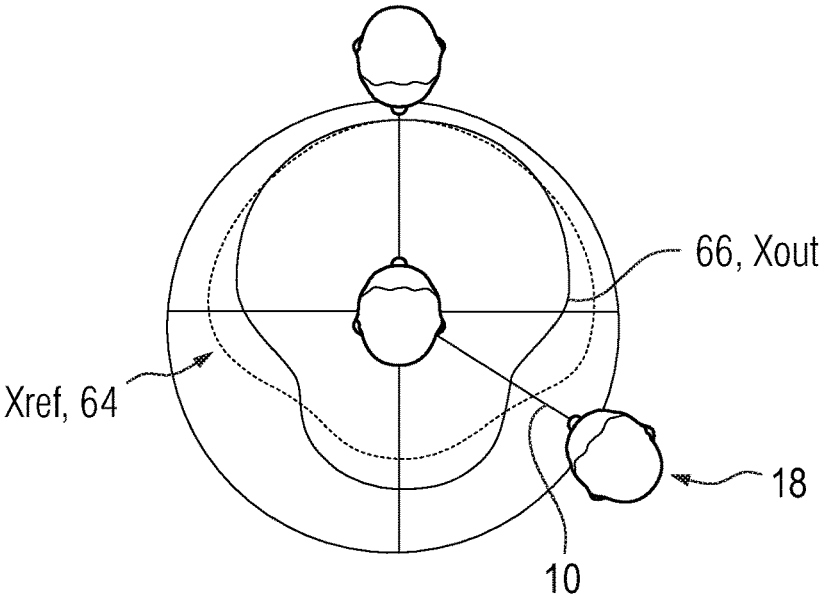
FIG. 3B is a top-plan view illustrating a directional characteristic of an alternative output signal resulting from the directional signal processing according to FIG. 2.

In FIG. 3B, instead of the omnidirectional reference directional characteristic 62, a reference directional signal Xref having a reference directional characteristic 64 is selected (dashed line), which models the filtering of the ambient sound by the pinna and corresponding shading effects. The first amplification parameter G1 is again selected in this case as 0 dB, while the second amplification parameter G2 is selected as −6 dB. The resulting directional characteristic 66 of the output directional signal Xout again has a noticeable deviation from the omnidirectional reference directional characteristic 64 in the direction of the second useful signal source 18, wherein an additional attenuation takes place in this direction due to the definition of the reference directional signal Xref, which is incorporated in the reference directional characteristic 64 as a result of the shading effects of the pinna.

Although the invention was illustrated and described in more detail by the preferred exemplary embodiment, the invention is not thus restricted by the disclosed examples and other variations can be derived therefrom by a person skilled in the art without leaving the scope of protection of the invention.

The following is a summary list of reference numerals and the corresponding structure used in the above description of the invention:

1 wearer
2 hearing aid
4 first conversation partner
6 first direction
8 second conversation partner
10 second direction
14 first useful signal source
18 second useful signal source
22 notch
24 first input transducer
26 second input transducer
28 sound signal
40 adaptive directional microphonics
42 adaptive directional microphonics
50 signal processing steps
52 output transducer
54 output sound signal
60 directional characteristic
62 (omnidirectional) reference directional characteristic
63 reference directional characteristic
64 reference directional characteristic
66 directional characteristic
a1 first superposition parameter
aeff1 first effective superposition parameter
aeff2 second effective superposition parameter
aref1 first reference superposition parameter
aref2 second reference superposition parameter
E1 first input signal
E2 second input signal
G1 first amplification parameter
G2 second amplification parameter
G2' corrected second amplification parameter
S1 first useful signal
S2 second useful signal
T1 first delay parameter
T2 second delay parameter
Xa rear-directed cardioid signal
Xc forward-directed cardioid signal
Xout output directional signal
Xr1 first directional signal
Xr2 second directional signal
Yout output signal
Z1 first intermediate signal
Z2 second intermediate signal

The invention claimed is:

1. A method for directional signal processing for a hearing aid, the method comprising:

generating a first input signal from a sound signal of the surroundings by using a first input transducer of the hearing aid;

generating a second input signal from the sound signal of the surroundings by using a second input transducer of the hearing aid;

forming each of a first directional signal and a second directional signal based on the first input signal and the second input signal;

providing the second directional signal with a relative attenuation in a direction of a first useful signal source;

providing the first directional signal with a relative attenuation in a direction of a second useful signal source;

ascertaining a first amplification parameter for an amplification of a first useful signal of the first useful signal source and a second amplification parameter for an amplification of a second useful signal of the second useful signal source;

defining a reference directional characteristic for a reference directional signal;

based on at least one of the first amplification parameter or the second amplification parameter as a function of the reference directional characteristic, ascertaining a corrected first amplification parameter and a corrected second amplification parameter, causing an output directional signal, formed as a sum of the first directional signal weighted by using the first corrected first amplification parameter and the second directional signal weighted by using the corrected second amplification parameter, to merge into a linearly scaled reference directional signal upon the first amplification parameter being equal to the second amplification parameter; and at least one of the corrected first or second amplification parameters being different from the corresponding underlying amplification parameter.

2. The method according to claim 1, which further comprises at least one of:

ascertaining the corrected second amplification parameter in such a way that the second useful signal is amplified by the second amplification parameter in relation to the reference directional characteristic by way of the output directional signal, or ascertaining the corrected first amplification parameter in such a way that the first useful signal is amplified by the first amplification parameter by way of the output directional signal in relation to the reference directional characteristic.

3. The method according to claim 1, which further comprises:

forming the corrected second amplification parameter as a product of the second amplification factor and a correction factor; and the correction factor corresponding to a linear coefficient of the second directional signal in a representation of the reference directional signal as a linear combination of the first directional signal and the second directional signal.

4. The method according to claim 1, which further comprises ascertaining the corrected first amplification parameter as the first amplification parameter when the first directional signal has its minimal sensitivity in a direction of the second useful signal source.

5. The method according to claim 1, which further comprises:

forming a first intermediate signal and a second intermediate signal based on the first input signal and the second input signal; and at least one of:

forming the first directional signal as a superposition of the first intermediate signal with the second intermediate signal, and simultaneously ascertaining an associated first superposition parameter, or forming the second directional signal as a superposition of the second intermediate signal with the first intermediate signal, and simultaneously ascertaining an associated second superposition parameter.

6. The method according to claim 1, which further comprises:

forming the corrected first amplification parameter as a product of the first amplification factor and a first correction factor; and forming the corrected second amplification parameter as a product of the second amplification factor and a second correction factor.

7. The method according to claim 5, which further comprises:

forming the corrected first amplification parameter as a product of the first amplification factor and a first correction factor;

forming the corrected second amplification parameter as a product of the second amplification factor and a second correction factor;

defining a first reference superposition parameter and a second reference superposition parameter for a superposition of the first intermediate signal and the second intermediate signal, forming the reference directional signal; and at least one of:

forming the first correction factor based on a product of the second superposition parameter with the second reference superposition parameter, or forming the second correction factor based on a deviation of a product of the first superposition parameter with the first reference superposition parameter from the second reference superposition parameter.

8. The method according to claim 6, which further comprises forming the output directional signal based on the first directional signal weighted by using the corrected first amplification parameter and based on the second directional signal weighted by using the corrected second amplification parameter.

9. The method according to claim 6, which further comprises:

ascertaining a first effective superposition parameter and a second effective superposition parameter based on the first and the second superposition parameters, the first and the second reference superposition parameters, and based on the first and second amplification parameters; and forming the output directional signal based on a superposition of the first intermediate signal weighted by using the first effective superposition parameter and the second intermediate signal weighted by using the second effective superposition parameter.

10. The method according to claim 9, which further comprises forming the first effective superposition parameter from the first reference superposition parameter, when the second directional signal is given by the second intermediate signal.

11. The method according to claim 6, which further comprises:

ascertaining a second effective superposition parameter based on the first superposition parameter, based on the corrected first amplification parameter, and based on the corrected second amplification parameter; and forming the output directional signal based on a superposition of the first intermediate signal weighted by using the first effective superposition parameter and the second intermediate signal weighted by using the second effective superposition parameter.

12. The method according to claim 11, which further comprises forming the second effective superposition parameter from the first superposition parameter and a ratio of the corrected second amplification parameter and the first amplification parameter, when the second directional signal is given by the second intermediate signal.

13. The method according to claim 1, which further comprises selecting the reference directional characteristic of the reference directional signal as an omnidirectional directional characteristic or selecting the reference directional characteristic of the reference directional signal to simulate a shading effect of the human ear.

14. A hearing system, comprising:

a hearing aid having a first input transducer for generating a first input signal from a sound signal of the surroundings and a second input transducer for generating a second input signal from the sound signal of the surroundings; and a control unit configured to carry out the method according to claim 1.

* * * * *